United States Patent [19]

Künzli et al.

[11] Patent Number: 4,583,720

[45] Date of Patent: Apr. 22, 1986

[54] APPARATUS FOR THE ZONE-ANNEALING OF A WORKPIECE CONSISTING OF A HIGH-TEMPERATURE MATERIAL

[75] Inventors: Roland Künzli, Mellingen; Günther Schröder, Birmenstorf; Robert Singer, Baden, all of Switzerland

[73] Assignee: BBC Brown, Boveri & Co., Ltd., Baden, Switzerland

[21] Appl. No.: 664,389

[22] Filed: Oct. 24, 1984

[30] Foreign Application Priority Data

Oct. 26, 1983 [CH] Switzerland ..... 5799/83

[51] Int. Cl.[4] ..... C21D 9/00

[52] U.S. Cl. ..... 266/81; 266/120; 266/131; 266/132; 266/259

[58] Field of Search ..... 266/120, 124, 130–134, 266/259, 78, 81, 90; 148/15, 20, 145

[56] References Cited

U.S. PATENT DOCUMENTS

| | | | |
|---|---|---|---|
| 2,116,069 | 5/1938 | Hoffman et al. | 266/120 |
| 2,182,364 | 12/1939 | Smith | 266/120 |
| 2,396,850 | 3/1946 | Hughes | 266/120 |
| 3,385,583 | 5/1968 | Jablonski | 266/124 |

FOREIGN PATENT DOCUMENTS

| | | | |
|---|---|---|---|
| 12130 | 6/1980 | European Pat. Off. | 148/15 |
| 846577 | 7/1981 | U.S.S.R. | 266/120 |

*Primary Examiner*—Christopher W. Brody

*Attorney, Agent, or Firm*—Oblon, Fisher, Spivak, McClelland & Maier

[57] ABSTRACT

An apparatus and a process for the zone-annealing of a workpiece (1) consisting of a high-temperature material, in which the workpiece (1) is hung on a suspension device (2) actuated via a roller (3) driven by a drive motor (4) and is provided with a plate-shaped covering screen (10) having an orifice. For the dipping of the workpiece (1), there is underneath the latter a salt bath (5) which is enclosed in an insulating vessel (6) and is provided with a heating system (7) with centrally symmetrical guide plates (8) and which is closed off at the top by means of a floating insulating cover (9). The cooling of the part of the workpiece (1) which is not immersed is guaranteed by a cooling body (11) through which cooling air (14) flows and which has a central passage (12) and, at the lower end of the passage (12), a projecting edge (13) serving as a stop for the covering screen (10). The intended grain structure can be adjusted when the feed speed of the workpiece (1) is varied in portions by means of a drive motor (4) and the amount of cooling air (14). The lateral heat flux is reduced by means of jacket-like heat-insulating cladding of the workpiece (1).

6 Claims, 5 Drawing Figures

(a)

(b)

(c)

APPARATUS FOR THE ZONE-ANNEALING OF A WORKPIECE CONSISTING OF A HIGH-TEMPERATURE MATERIAL

BACKGROUND OF THE INVENTION

1. Field of the Invention

The invention relates to a method and apparatus for zone-annealing of the generic type.

2. Description of the Prior Art

It is known that workpieces consisting of high-temperature materials, especially of dispersion-hardened high-temperature alloys, such as nickel-based superalloys, have to undergo coarse-grain annealing at the end of their production process. This heat treatment is necessary in order, in particular, to achieve good mechanical properties (high creep resistance) at high operating temperatures and to obtain grains which are elongated in the direction of tensile stress and which have increased strength and ductility. This can be accomplished by means of so-called zone-annealing if a temperature gradient in the appropriate direction is employed (see U.S. Pat. No. 221,979 of July 31, 1972, now abandoned, and No. DE-B-2,303,802).

The problem arising in all existing zone-annealing plants is that, particularly when the geometry of the workpiece is complicated, it is only rarely possible to force the temperature gradient to follow the desired longitudinal direction in an ideal manner. There is therefore the need to seek new methods and processes associated with them.

SUMMARY OF THE INVENTION

The object on which the invention is based is to provide an apparatus for the zone-annealing of workpieces consisting of heat-resistant materials, especially superalloys, and a specific process which can be carried out with the apparatus, which allow measures for increasing the longitudinal temperature gradient and lowering the lateral temperature gradient and which make it possible to vary the temperature gradient and the feed speed. It will also be possible to zone-anneal workpieces of complicated geometry in a simple way.

BRIEF DESCRIPTION OF THE DRAWINGS

The invention is described with reference to the following exemplary embodiment explained in more detail by means of Figures.

DETAILED DESCRIPTION OF THE PREFERRED EMBODIMENTS

Figure 1:
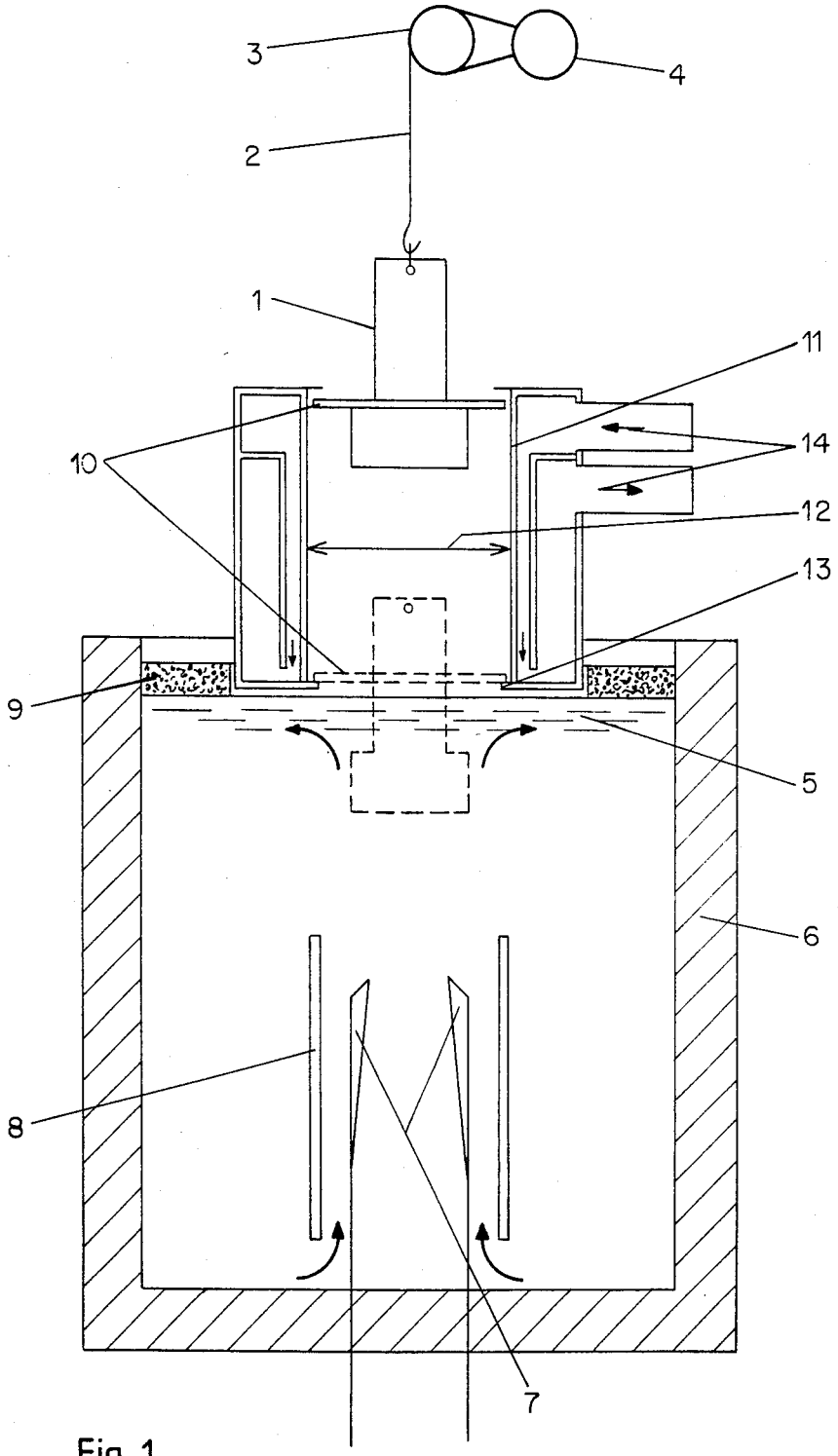
FIG. 1 shows diagramatically a zone-annealing apparatus in elevation and in a longitudinal section.

FIG. 1 illustrates diagramatically an apparatus for the zone-annealing of workpieces consisting of heat-resistant materials partially in elevation and partially in longitudinal section. 1 denotes the workpiece which in the present case is stepped and has a shank part and a root part for example, a turbine blade consisting of a nickel superalloy with a thickened root and a slender shank. The workpiece 1 hangs via a hook on a suspension device 2 such as a chain or wire rope which can be actuated via a roller 3 driven by a drive motor 4 for the purpose of raising and lowering the workpiece 1. 5 denotes a salt bath which is maintained at the zone-annealing temperature and which is arranged in an insulating vessel 6 and is completely enclosed by the latter with the exception of the bath surface. 7 designates the heating system of the salt bath 5, which heating system is surrounded concentrically by a centrally symmetrical guide plate 8 and which serves for guiding a favorable flow of the fluid of the salt bath 5. This flow is indicated by arrows. Located on the surface of the salt bath is a floating insulating cover 9 which protects at least the round parts of the equipment from excessive thermal radiation and harmful effects. For the same purpose, there rests on the thicker root part of the workpiece 1 a plate-shaped covering screen 10 which is provided with an orifice and which moves along part of the vertical movement path of the workpiece 1. Both the workpiece 1 and the covering screen 10 are indicated in the Figure in the raised position (unbroken lines) and in the lowered position (broken lines). In the upper central part of the apparatus, there is a cooling body 11 through which the cooling air 14 flows axially. It possesses a passage 12 somewhat larger than the periphery (or diameter) of the covering screen 10, so that the latter can slide vertically in the cooling body 11 without friction. The cooling body 11 is provided on its lower end face with an inwardly projecting edge 13 which serves as a stop for the covering screen 10 during the downward movement of the workpiece 1. The orifice (not shown) in the covering screen 10 has such dimensions that the latter possesses sufficient play relative to the profile of the shank part of the workpiece 1, so that when the latter dips into the salt bath 5 it can slide through the orifice unimpeded.

Figure 2:
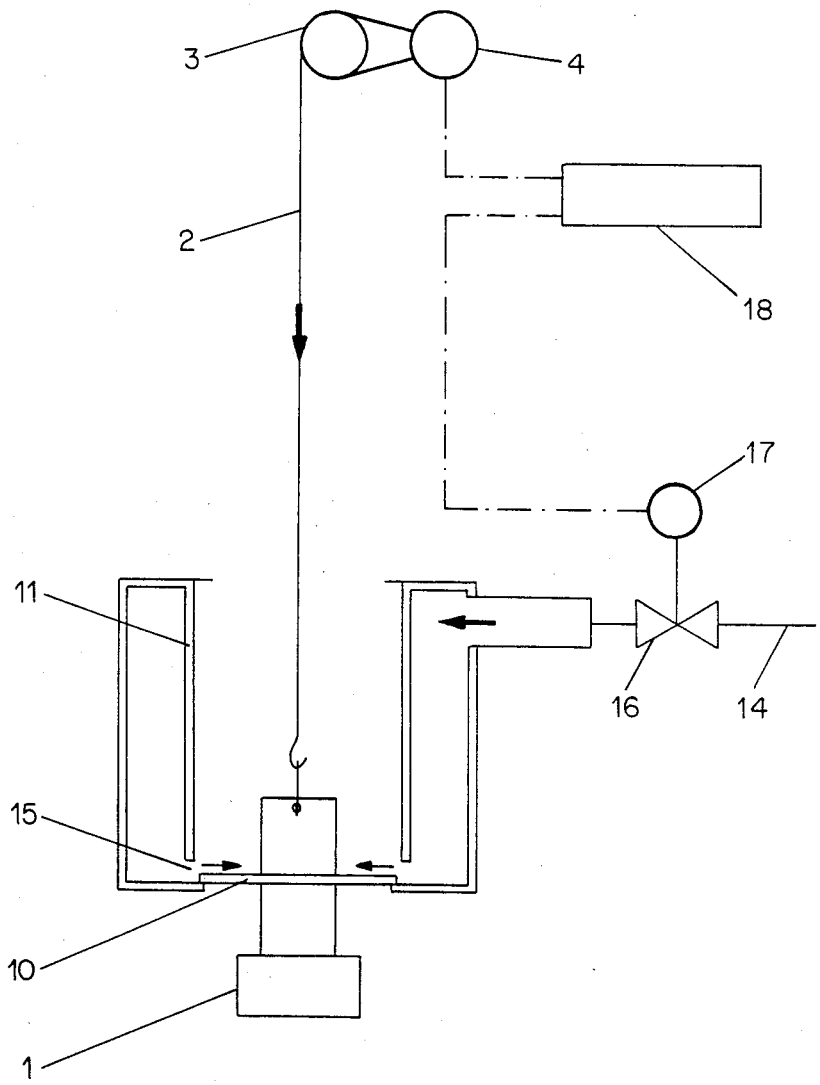
FIG. 2 shows a further design of an apparatus with an especially designed cooling system.

FIG. 2 shows in elevation and in section a further embodiment of the apparatus with a specially designed cooling system. Reference numerals 1, 2, 3, 4, 10 and 11 refer to elements correspond exactly to those of FIG. 1. The cooling body 11 is provided at its bottom, and on its inner periphery, with a lateral orifice 15 which is intended for the outflow of the cooling air 14 and which makes it possible for the latter to flow radially against the workpiece 1. The amount of cooling air 14 is adjusted to satisfy the particular operating conditions required, as a function of the movement of elements 1, 2, 3 and 4 (defining the position and dipping rate of the workpiece 1), by a control unit 18 via a servo-motor 17 and a control valve 16. This interdependence is indicated by a dot-and-dash line in the Figure.

Figure 3:
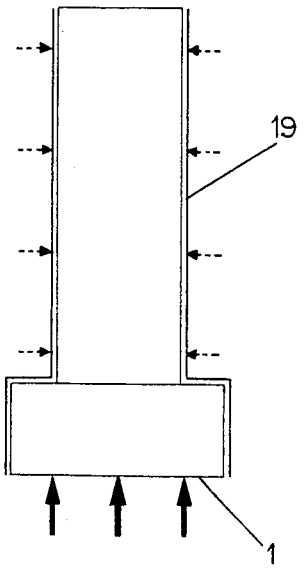
FIG. 3*a* shows a covering consisting of ceramic material.
FIG. 3*b* shows an envelope consisting of heat-insulating material.
FIG. 3*c* shows thermal insulating material.
Figure 3:
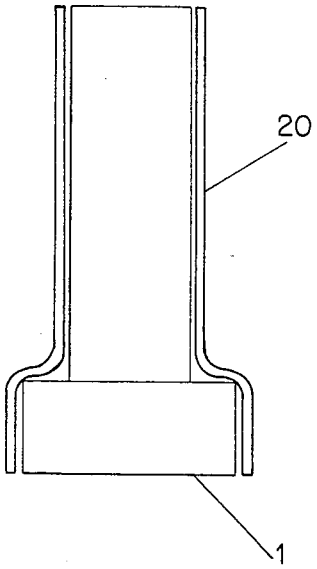
Figure 3:
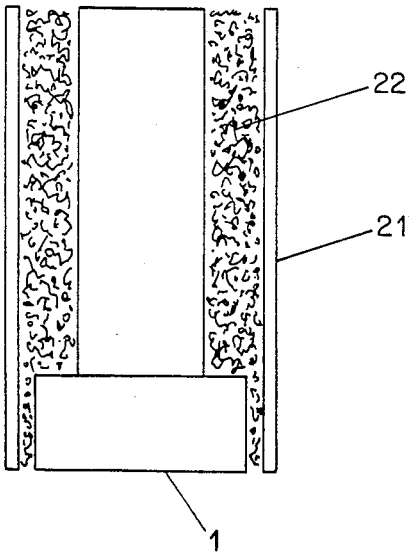

FIGS. 3*a* through 3*c* illustrates various means of reducing the heat flow in the transverse direction of the workpiece 1.

According to FIG. 3*a*, the workpiece 1 is provided on its shell surfaces, but not on its end faces, with a covering 19 consisting of ceramic heat-insulating material. The heat flow entering the lower end face of the workpiece 1 dipped into the salt bath can pass unimpeded through the workpiece 1 in a vertical direction (the arrows pointing directly upwards). In contrast to this, the heat flow directed transversely is throttled sharply (the horizontal broken arrows).

FIG. 3*b* shows a similar cladding in the form of an envelope 20 which consists of heat-insulating material and which has previously been slipped over the workpiece 1 to be treated.

According to FIG. 3*c*, the lateral thermal insulation of the workpiece 1 is effected by means of a more or less loose thermal insulating material held together and closed off by means of a tube 21.

PRACTICAL EXAMPLE

A gas-turbine blade consisting of a high-temperature material was subjected to a zone-annealing process by means of the apparatus according to FIG. 1. The workpiece 1 consisted of an oxide-dispersion-hardened nickel-based superalloy of the following composition:

Cr=15% by weight
Mo=2% by weight
W=4% by weight
Al=4.5% by weight
Ti=2.5% by weight
Ta=2% by weight
$Y_2O_3$=1.1% by weight
Ni=the remainder The dimensions of the turbine blade were:

Shank length=120 mm
width=100 mm
thickness=30 mm

Root length=80 mm
width=120 mm
thickness=40 mm

The mean grain size of the untreated material before annealing was approximately 0.2 microns, equiaxial.

The salt bath 5 of the apparatus was heated to a temperature of 1260° C. by means of the heating system 7 and was maintained at this temperature as constantly as possible during the course of the process. An envelope 20 consisting of heat-insulating material (see FIG. 3*b*) and a covering screen 10 cut to a suitable size were slipped onto the workpiece 1. The workpiece was then successively lowered vertically into the hot salt bath 5 at a speed of 2 mm/min until it was completely immersed. After the workpiece 1 had been taken out and cooled, the grain size was determined. It was possible to detect longitudinally directed fringe crystals averaging a length of 40 mm, a width of 5 mm and a thickness of 2 mm.

In a further test, both the envelope 20 and the covering screen 10 were omitted. In this case, it was possible to detect a fine-grain edge zone 0.2 mm thick on the workpiece 1 after zone-annealing. Moreover, there was a considerable grain growth in the root part of the workpiece 1, and the fringe crystals were arranged obliquely relative to the longitudinal axis of the latter.

The apparatus and the process which can be carried out with it are not restricted to the exemplary embodiment. By means of the apparatus according to FIGS. 1 to 3*c*, other high-temperature materials which are superalloys of the class given in the example can also be zone-annealed successfully. Because of the use of appropriate heat-insulating claddings similar to those of FIGS. 3*a* through 3*c*, even complicated workpieces can be treated, and the various operating parameters can be coordinated with one another as efficiently as possible.

It should be mentioned, in particular, that the apparatus makes it possible to adjust the zone-annealing conditions according to the material and the workpiece in steps. The temperature gradient and feed speed of the workpiece can be varied in a suitable way during the annealing process. This is especially useful when the texture and structure are to vary over the length of the workpiece, for example where the root part has a different grain size and grain form from the shank part. This can be carried out in a simple way by regulating the drive motor 4 (stepping motor) and varying the amount of cooling air 14 (compressed air).

Obviously, numerous modification and variations of the present invention are possible in light of the above teachings. It is therefore to be understood that within the scope of the appended claims, the invention may be practiced otherwise than as specifically described herein.

We claim:

1. An apparatus for the zone-annealing of a workpiece made of a high temperature material, comprising:
- means for vertically raising and lowering said workpiece,
- a vessel defining a salt bath;
- means in said vessel for heating said salt bath;
- means in said vessel for guiding said salt bath to have a vertical flow path along a central part of said vessel;
- a cooling body positioned immediately above said vessel, and having a vertical passage therethrough;
- means for flowing cooling air through said cooling body;
- a floating insulating cover closing off a top of said salt bath around said cooling body;
- a covering screen having an orifice for insertion of said workpiece and an outer periphery having the dimensions of said vertical passage; and
- an inwardly projecting edge at a bottom of said vertical passage for engaging said covering screen,
- whereby said covering screen can slide vertically downward with said workpiece to said projecting edge through said vertical passage as said workpiece is lowered therethrough.

2. The apparatus of claim 1, wherein said means for vertically raising and lowering includes a drive motor and wherein said cooling body includes:
- an air orifice at the bottom of said vertical passage for providing a flow of cooling air from said cooling air flow means to said vertical passage;
- valve means for controlling said cooling air flow;
- a servo-motor controlling said valve means;
- control means responsive to said drive motor for controlling said servo-motor.

3. The apparatus of claim 1 including a heat insulating cladding covering only lateral portions of said workpiece.

4. The apparatus of claim 3, wherein said cladding covering comprises a ceramic coating.

5. The apparatus of claim 3, wherein said cladding covering comprises a heat insulating envelope.

6. The apparatus of claim 3, wherein said cladding covering comprises a tube containing insulating material.

* * * * *